United States Patent [19]

Stocker

[11] 4,180,891

[45] Jan. 1, 1980

[54] FASTENER FOR BANDS OR THE LIKE

[75] Inventor: Alberto Stöcker, Wuppertal, Fed. Rep. of Germany

[73] Assignee: Schaeffer Homberg GmbH, Wuppertal, Fed. Rep. of Germany

[21] Appl. No.: 969,696

[22] Filed: Dec. 15, 1978

[30] Foreign Application Priority Data

Jan. 4, 1978 [DE] Fed. Rep. of Germany ..... 2800288

[51] Int. Cl.[2] ..... A44B 19/00; A41D 1/06

[52] U.S. Cl. ..... 24/206 B; 2/237

[58] Field of Search ..... 24/206 B; 2/237

[56] References Cited

U.S. PATENT DOCUMENTS 3,872,554 3/1975 Wolfertz ..... 24/206 B

FOREIGN PATENT DOCUMENTS 2408018 8/1975 Fed. Rep. of Germany ..... 24/206 B

*Primary Examiner*—Bernard A. Gelak

*Attorney, Agent, or Firm*—Martin A. Farber

[57] ABSTRACT

A fastener for bands or the like, particularly on pants, skirts, pockets or the like with a catch rail which is fastened on one band-part on which catch rail a slide can be displaced, the slide being fastened on the other band-part, which slide carries a folding lever, the folding lever continuing under its folding axis passing into a catch projection and having a window-shaped opening for insertion therein of a strip which covers the catch rail and the slide. The slide-side band-fastening point engages on the folding lever.

9 Claims, 9 Drawing Figures

FIG. 5
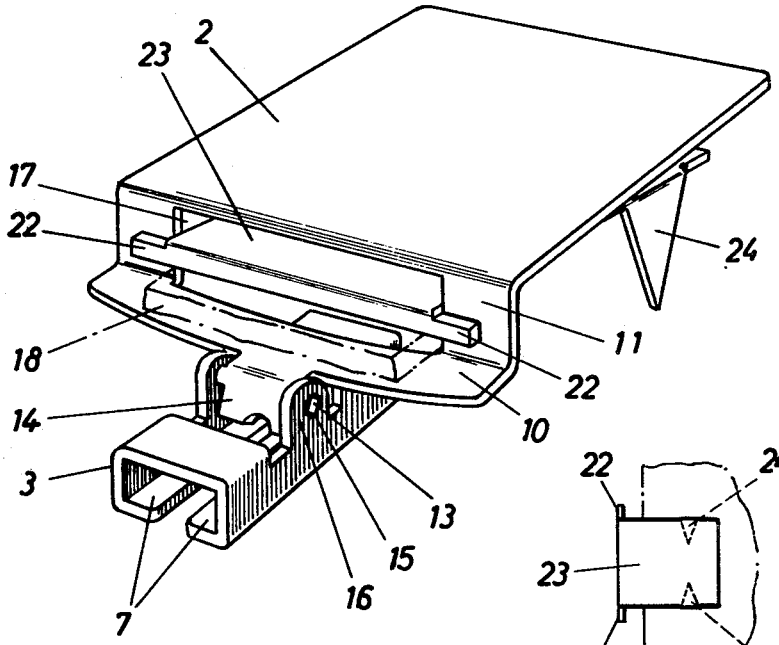
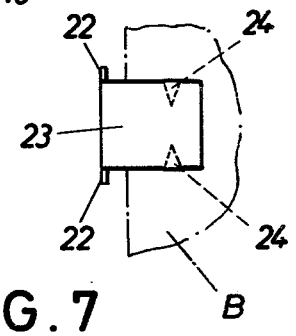
FIG. 7
FIG. 6
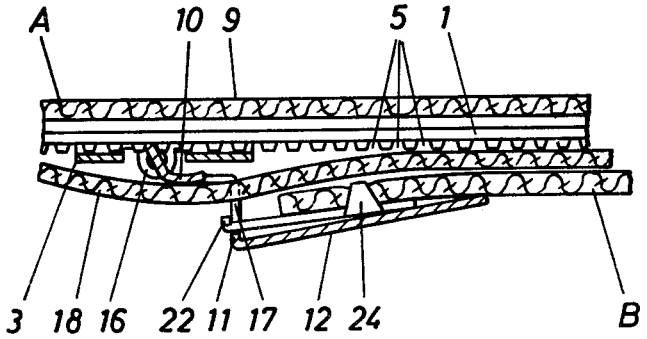

FASTENER FOR BANDS OR THE LIKE

The invention relates to a fastener for bands or the like, particularly on pants, skirts, pockets or the like with a catch rail which is fastened on one band-part on which catch rail a slide can be displaced, the slide being fastened on the other band-part, which slide carries a folding lever, the folding lever continuing under its folding axis passing into a catch projection and having a window-shaped opening for insertion therein of a strip which covers the catch rail and the slide.

Such a strip which is rigidly held on both sides basically fulfills two main functions. On the one hand it forms an effective protective covering with respect to the comparatively coarse or rough catch rail, so that in this manner a certain protection against wear is obtained with respect to the clothing which lies thereover; on the other hand this strip also covers with the functioning parts from sight. Thus, the rail, the catch projection of the folding lever and the slide are completely covered by the strip. The fastening of the catch rail onto a portion of the band is brought about by sewing it on; the fixing onto the other portion of the band takes place on a tongue which is formed in one-piece with the sled or slide. The tongue is formed wider than the sled. The securing takes place by use of conventional U-shaped staples or the like. The folding lever which lies flat in the closed position can be actuated without impairment of the covering function of the strip, since the window-shaped opening lies in the immediate vicinity of the axis of the folding lever. The securing of the closed position is caused by an upper dead point position of the catch projection. That is why the folding lever can spring into the opening position by an unintentional slight displacement of the folding lever.

It is one object of the invention, that is, particularly and additionally to the tasks and objects which may be gathered from the specification and claims, to provide a fastener for bands or the like, which can be formed in a simple manufactureable construction, which is reliable in use, such that additional closing security is provided solely on the basis of the type of coordination of such a fastener.

It is another object of the present invention to provide a fastener of the introductory-mentioned type, wherein as at least a partial aid to the solution of the above-mentioned object, the slide-side band-fastening point takes hold or engages on the folding lever (2).

It is another object of the present invention to provide a fastener of the above-mentioned type wherein the folding lever (2) is bent Z-shaped and the window-shaped opening (17) is located in the Z-stay.

It is another object of the present invention to provide the fastener with a clamping or connecting tab (20) for clamping the band material, which tab is bent inwardly out from the window-sided edge (19) of the upper Z-leg (12).

Further advantageously the engaging position of the band to the folding lever is formed by an articulation point.

It is another object of the present invention to form this articulation point from laterally projecting pins (22) of a plate (23), the latter being seated or mounted on the band-part (B), with the plate being inserted through the window-shaped opening (17).

Further according to another object of the present invention the plate (25) including its articulation pins

(26) is cut freely by stamping or punching it out from the window-shaped opening (27) out of the folding lever (2).

It is another object of the present invention to provide a fastener wherein the Z-stay (11) forms an undercut as a result of its inclined position (angle alpha).

It is still another object of the present invention to provide the fastener with notches (28) which are freely cut in the folding lever (2) complementary or corresponding to the articulation pins (26) and are arranged in the area of the lower Z-leg (10) on that edge (29) of the window-shaped opening (27) which edge (29) points toward (i.e., is on the side of the opening adjacent to) the folding axis.

It is another object of the present invention to form the slide (3) merely of a C-profile with two bearing tabs (16) for the folding axis, the bearing tabs being arranged in the vicinity of the divided or interrupted C-stay (3'), the C-profile surrounding the catch rail (1).

As a result of such formations a fastener is produced of increased utility or useability: By the band-fastening position on the slideside, acting or engaging on the folding lever, the latter is held in the closed position with continuous pressure or tension. The upper dead point position of the catch projection, in this manner is optimumly held and secured. The construction can be kept altogether simple. The slide no longer needs any holding tongue. In this manner the slide becomes even more compact, which not only saves material but also favors storage and shipping. In the manner that the folding lever is angled or bent-off in the shape of a Z, and the window-shaped opening is also located in the Z-stay, in no way is the foldability of the folding lever impaired. Also passage of the cover strip is obtained which is low in wear. The catch projection-sided Z-leg (i.e. the Z-leg on the side of the catch projection) forms a wide support surface which is aligned parallel to the running or direction of extent of the rail.

This leg can be arched so that a sharp cutting-edge-like contact is avoided between the cover strip and the lever or folder. Also the upper window-sided edge of the Z-leg is formed advantageously for guiding in the manner that this Z-leg is rolled or bent downwardly with the simultaneous formation of a clamping tab (20) for clamping the band material. The thus formed "holding staple" or clamp is formed from the material of the window-shaped opening.

Another possibility for formation of the application or engaging place of the band material resides in the formation of an articulation position. In an advantageous manner the latter is formed by laterally projecting pins of a plate, which plate is seated on the band part, the plate passing through the window shaped-opening. Also here, naturally, this could be a wire strap or the like. In order to obtain a manufacturing operation which conserves material, with the plate version, in a favorable manner, the plate including its articulation pins are freely cut out while stamping out the window-shaped opening from the folding lever. In such a case the finished lever or folder has a Z-stay, which as a result of the inclined position forms a type of undercut. This measure serves to secure such a plate (which is freely cut or stamped out from the folding lever) in position. In this case it is then even advantageous for the recesses which are freely cut in the folding lever and which correspond to the articulation pin to lie in the area of the lower Z-leg on that edge of the window-shaped opening which points to (i.e., is adjacent to) the folding axis. The cover strip which passes through the window-shaped opening itself prevents the plate from again releasing or disconnecting. As a result an additional function is provided for the cover strip. In every position of use the cover strip holds the articulation pins on one plane above the recesses. Finally an advantageous feature of the invention exists in that the slide merely comprises a C-profile with two bearing tabs for the folding axis, the bearing tabs being arranged in the area of the interrupted portion of the C-stay (3'), the C-profile surrounding the catch rail.

With the above and other objects and advantages in view, the present invention will become more clearly understood in connection with the detailed description of several preferred embodiments, when considered with the accompanying drawings, of which:

FIG. 5 is a perspective individual illustration of the fastener according to a second embodiment example;

FIG. 6 is a section corresponding to FIG. 3 through the fastener according to FIG. 5;

FIG. 7 is a plan view of the plate which is fastened on the band material, substantially in actual scale;

Figure 1:
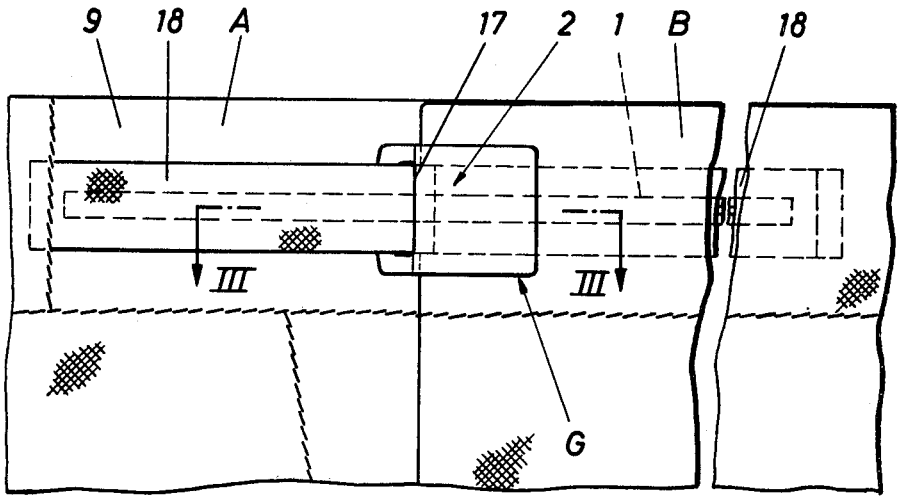
FIG. 1 is a plan view of a fastener applied on a waistband of pants in accordance with a first embodiment example, and partially broken away.
Figure 2:
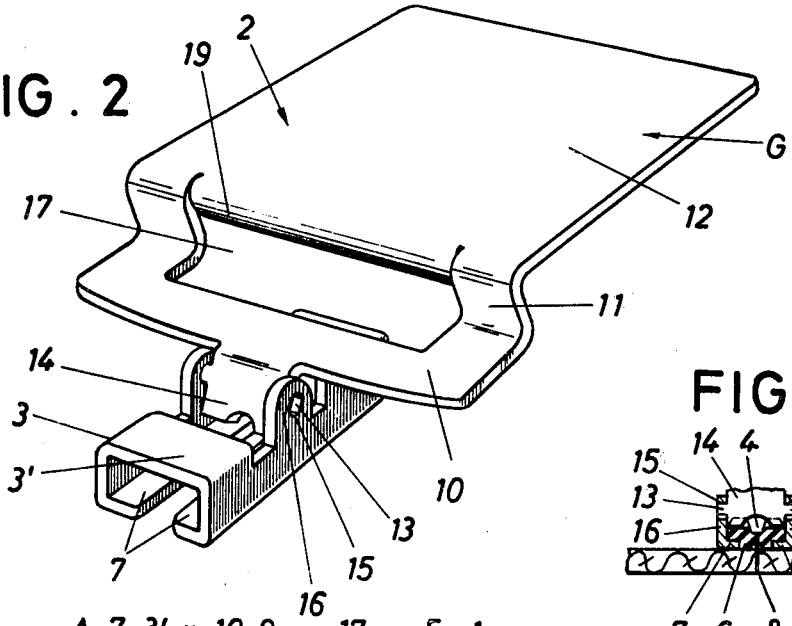
FIG. 2 is a perspective individual illustration of the fastener, illustrating the C-profiled slide with clamping tab and folding lever, the latter being articulated in the area of its stay.

Referring now to the drawings, the fastener of all embodiments is guided slide-like on a closely toothed catch rail 1 and has a folding lever 2 as well as a slide 3, the former being mounted on the slide.

The rail 1 is provided with catch recesses 5 between the teeth thereof, which recesses extend transversely and are divided by means of a centrally running sew-on recess 4 for sewing the rail onto the band. The rail base 6 is contracted or drawn-in step-like.

The slide 3 is formed with a C-profile slidably surrounding the rail 1. The C-legs are bent-off doubly from the cover portion or stay 3' of the slide 3 such that they engage behind the rail 1 by means of guide tabs 7.

The slide 3 is pushed on over the end of the rail which is fixed last. A seam 8 fixedly holds the rail 1 and consequently the fastener onto the band part A of the waistband 9 of the pants.

The Z-shaped bent folding lever 2 has a shorter Z-leg 10. The Z-stay portion 11 of the lever is connected to the Z-leg 10. The Z-leg 11 transfers or extends into a longer Z-leg 12, the latter forming the gripping handle G. In the closed position of the fastener the Z-leg 10 extends approximately parallel to the catch rail 1. The other Z-leg 12 extends slightly inclined relative to the catch rail 1 (cf. FIG. 3).

Figure 4:
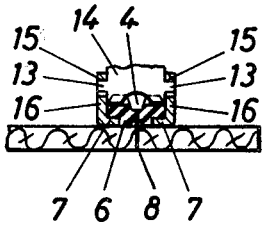
FIG. 4 is a cross-sectional view through the articulation point of the folding lever-slider.

The folding axle of the folding lever 2 is formed from projections 13 from the material of a catch projection 14, the latter being connected to the Z-leg 10. The material projections 13 are likewise taken into consideration and produced during the stamping-out manufacturing operation. The material projections 13 project as axles, each into one bearing bore 15 of the bearing eyes 16 of the legs or sides of the C-profile of the slide 3. The bearing eyes 16 are also produced, correspondingly taken together into consideration during the stamping out operation. For assembling the parts, the bearing eyes 16 are slightly pressed outwardly. After a proper congruent alignment of the material projections 13 with the bearing bores 15, the bearing eyes again are pressed back into the parallel position, which position is evident from FIG. 4. Then the folding lever 2 is held on the slide 3 without being able to become loose and get lost.

In the area of the folding axis, the substantially rectangular folding lever 2 is formed with a window-shaped opening 17. This permits the free passage therethrough of a cover strip 18 which is arranged on the outside in front of the rail 1, the cover strip 18 being fixed on its free ends onto the waistband 9. The cover strip 18, which has a width corresponding thereto, not only covers the rail 1 and the catch projection 14, but also covers both the slide 3 as well as the folding axle-sided Z-leg 10 from view, the leg 10 forming the window opening-frame leg which exists there.

Figure 3:
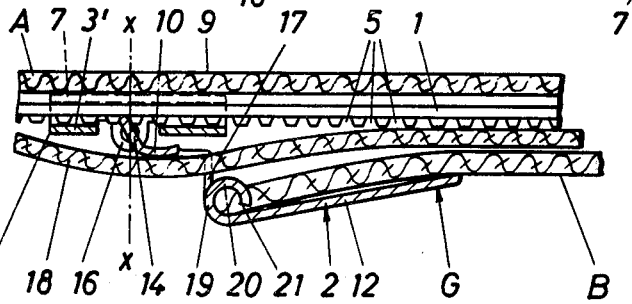
FIG. 3 is a section taken along the line III—III of FIG. 1.

In the locked position, the catch projection 14 steps over the dead point line x—x (compare FIG. 3). Upon reaching the dead point position the rail 1 is compressed stronger. As further evident from FIG. 3, with respect to the catch projection 14, only a very short lever length exists. This lever length stands opposite to a far larger lever length of the actuation handle. The folding axle is disposed in the upper one-third of the angle leg which forms the catch projection 14.

The slide-side band-fastening position (that is, the fastening of that part or side of the band which is on the side of the slide) is on the folding lever 2. In the area of the window-side edge 19 of the upper leg 12 (the latter constituting the gripping handle G), the folding lever 2 forms a clamping stay 20 for clamping of the other waistband-part B. The material which forms the clamping stay 20 is that taken from the window-shaped opening 17. This material is bent-off or rolled in under the leg 12 in this embodiment example. The degree of the rolling-in is such that the edge 21 of the clamping stay practically again points back in the direction of the window edge 19. Since the material section of the band there, most of the time, consists of several layers, with this relatively simple means an extremely biasable or loadable securing is achieved. This securing location also lies so close to the axis that the gripping handle can be folded or tilted up without obstruction. On the other hand a loading or biasing in the direction of the closed position of the folding lever 2 is exerted on the folding lever 2 by the pulling or tensile forces on the waistband, so that in this manner the upper dead point position x—x is effectively guaranteed and secured.

The edge 21 of the clamping stay 20 can be toothed.

With the embodiment examples according to FIGS. 5-9 the engagement position is formed from a hinge of articulation position.

With an otherwise similar or like construction, with respect to the construction according to FIG. 5, a plate 23 provided with lateral projecting pivot pins 22 is held on the band part B by means of tabs or staples 24 or the like, and indeed after prior insertion of the pinless end of the plate 23 through the window-shaped opening 17 of the Z-shaped folding lever 2. The articulation pins 22 step blockingly against the Z-stay 11. The window-shaped opening 17 has a height which corresponds to a multiple of the thickness of the plate 23. In this manner a large pivotability is provided. On the other hand the height of the opening 17 is selected such that the diagonal width of the opening 17 is less than the end spacing of the pivot pins 22. The cover strip 18 exists from under the plate 23. As evident from FIG. 6, since the plate 23 is placed on the waistband end, the pivot zone which is somewhat stiffened by the bend or angling-off, extends substantially without being contacted above the cover strip 18. With stronger pulling forces or loads which are to be expected, the angle zone also can be pulled or drawn forward up to the area of the pivot pins so that highly reinforced pivot axes are formed.

The claws 24 already can be considered and formed on the edge of the plate 23 during the free cutting production. Naturally also the possibility exists to freely cut them from the center of the plate and after introduction of the latter into the window opening 17, to bend them out and then to connect them with the band material.

Figure 8:
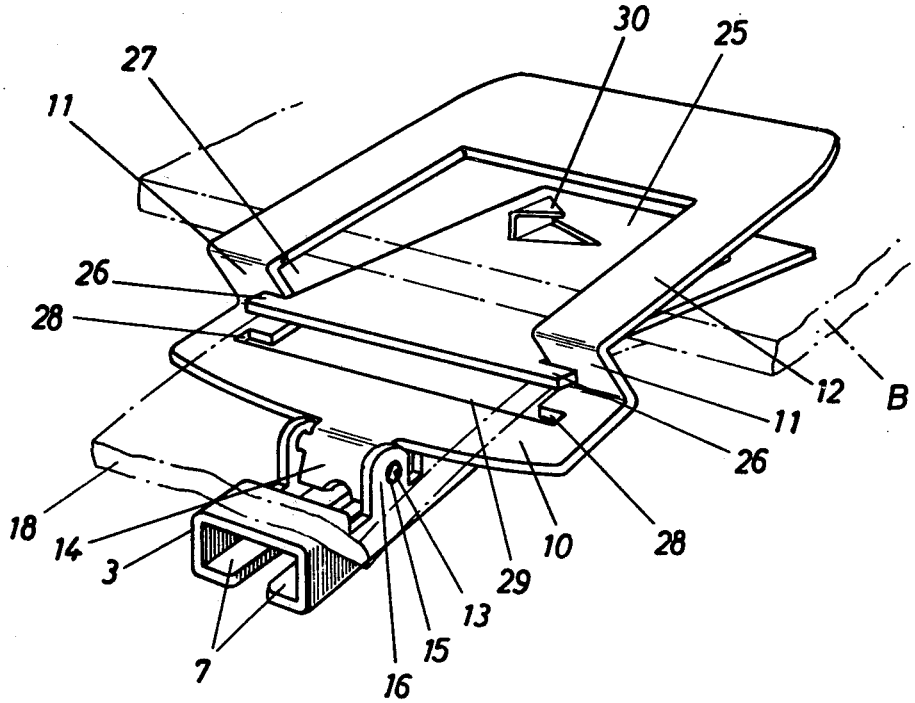
FIG. 8 is a perspective individual illustration of the fastener according to a third embodiment example.
Figure 9:
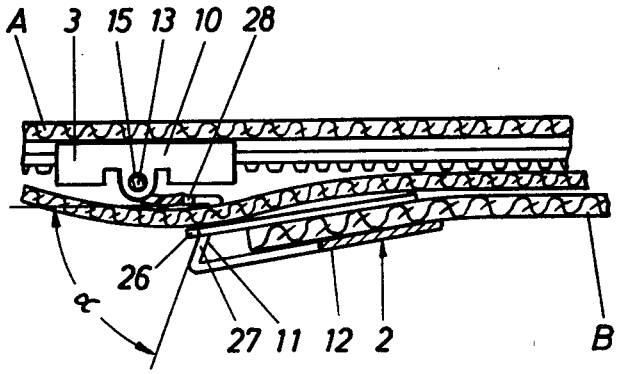
FIG. 9 is a section corresponding to FIG. 3 through the fastener according to FIG. 8.

With the embodiment according to FIGS. 8 and 9, the plate 25 including its pivot pins 26, with formation of here in any event an enlarged window-shaped opening 27, can be freely cut out from the folding lever 2 during its production. The latter is provided such that the notches 28 (corresponding to the pivot pins 26) lie in the area of the lower (that is, the catch projection-sided) Z-leg 10 of the lever 2, and indeed on that edge 29 of the window-shaped opening 27 which points toward the folding axis 13. As evident from FIG. 8, the cover strip 18 lies underneath the plate 25. In this manner and as a result of the measure that the notches lie as close to the axis as possible, a departure of the pivot pins 26 from the notches 28 is avoided with the folding lever 2 flipped up. The cover strip 18 itself blocks the notches so that the pivot pins 26 can even slide over the stay-side sections of the leg 10. The cover strip is always thicker than the width of the notches.

The cutting free of the plate 25 makes possible the completely automatic attachment of the pants-fastener, as well as also an exchange or replacement after attachment without deforming of the attached claws 24, since the plate 25 which is fastened to the waistband of the pants (as long as the cover strip 18 is not threaded or passed through) may be put in, and respectively angled out of the folding lever 12 through the window-shaped opening 27. In addition the correspondingly selected window height or level contributes to this with the previously described solutions. The plate 23 is diagonally aligned in the opening 17.

Moreover claws 30 for fastening of the waistband part B are cut freely from the plate 25. In the present case the band material substantially covers the plate 25.

As further evident from FIGS. 8 and 9, as a result of its axis-sided front-folding there, the Z or S-stay has an inclined position in the form or type of an undercut. This measure effectively prevents the plate 25 from sliding up to the range of the outer end of the folding lever. The support channel, formed at an acute angle alpha, causes the plate 25, under the continuously existing pulling action, always to be held in contact or engagement on the Z-stay 11, and respectively, to be pulled in the direction of the base of the channel.

While I have disclosed several embodiments of the invention it is to be understood that these embodiments are given by example only and not in a limiting sense.

I claim:

1. A fastener for a band or the like, particularly on pants, skirts, pockets or the like, with a covering strip, comprising a catch rail adapted to be fastened on one part of the band, a slide displaceably disposed on said catch rail, said slide being adapted to be operatively fastened on another part of the band constituting a slide-side band-fastening position, a folding lever being pivotally mounted on said slide defining a folding axis, said folding lever extending under said folding axis to a catch projection, said catch projection adapted to engage with said catch rail, said folding lever forming a window-shaped opening, the strip covering said catch rail and said slide extends through said opening, said slide-side band-fastening position of said another part of said band being operatively fastened to said folding lever.

2. The fastener according to claim 1, wherein said folding lever is bent in a Z-shape forming two legs and a Z-stay therebetween, said window-shaped opening is formed in said Z-stay.

3. The fastener according to claim 2, wherein one of said legs is an upper Z-leg, the latter forming one edge of said window-shaped opening, clamping stay means for clamping said another part of the band is inwardly bent from said one edge of said upper Z-leg.

4. The fastener as set forth in claim 1, wherein said fastening position of said another part of the band constitutes an application position of the band material, said application position is formed from an articulation point.

5. The fastener as set forth in claim 4, further comprising a plate is mounted on said another part of the band, said plate is formed with laterally projecting pins, said plate is inserted in said window-shaped opening of said folding lever, said articulation point is formed by said laterally projecting pins of said plate.

6. The fastener as set forth in claim 1 or 4, further comprising a plate is mounted on said another part of the band, said plate is formed with articulation pins, said plate including said articulation pins is freely cut from and upon stamping out said window-shaped opening from said folding lever.

7. The fastener according to claim 6, wherein said folding lever has two Z-legs and a Z-stay therebetween.

said Z-stay is inclined relative to said legs forming an undercut.

8. The fastener as set forth in claim 7, wherein said window-shaped opening defines an edge pointing toward said folding axis, said folding lever is formed with notches freely cut therein corresponding to said articulation pins, and said notches are arranged in a lower of said Z-legs at said edge.

9. The fastener as set forth in claim 1, wherein said slide is formed with an interrupted C-stay, said slide has a C-profile with two bearing tabs constituting means cooperating with said folding lever for forming said folding axis, said C-profile slidably surrounds said catch rail, said two bearing tabs are arranged in the vicinity of said interrupted C-stay.

* * * * *